US006351212B1

(12) United States Patent
Lynch

(10) Patent No.: US 6,351,212 B1
(45) Date of Patent: Feb. 26, 2002

(54) SYSTEM FOR MONITORING OPERABILITY OF FIRE EVENT SENSORS

(76) Inventor: Adam Q. Lynch, 1801 Bridgeview Cir., Orlando, FL (US) 32824

( * ) Notice: Subject to any disclaimer, the term of this patent is extended or adjusted under 35 U.S.C. 154(b) by 0 days.

(21) Appl. No.: 09/512,153

(22) Filed: Feb. 24, 2000

Related U.S. Application Data

(63) Continuation-in-part of application No. 09/237,817, filed on Jan. 27, 1999, now Pat. No. 6,081,195.
(60) Provisional application No. 60/072,850, filed on Jan. 28, 1998.

(51) Int. Cl.[7] ..... G08B 29/00
(52) U.S. Cl. ..... 340/506; 340/505; 340/507; 340/514
(58) Field of Search ..... 340/506, 505, 340/507, 508, 514, 517, 518, 628, 601, 632

(56) References Cited

U.S. PATENT DOCUMENTS 4,088,986 A * 5/1978 Boucher ..... 340/506
4,575,711 A 3/1986 Suzuki et al. ..... 340/521
4,595,914 A 6/1986 Siegel ..... 340/515
4,881,060 A * 11/1989 Keen et al. ..... 340/511
4,965,556 A 10/1990 Brodecki et al. ..... 340/628
5,121,101 A * 6/1992 Jakubowski et al. ..... 340/515
5,619,184 A * 4/1997 Torikoshi et al. ..... 340/506
5,793,297 A 8/1998 Takeuchi et al. ..... 340/635

* cited by examiner

*Primary Examiner*—Donnie L. Crosland
(74) *Attorney, Agent, or Firm*—Dale J. Ream

(57) ABSTRACT

A system for monitoring the operability of fire event sensors having a programmable logic circuit which automatically and continuously analyzes whether readings obtained from fire event sensors satisfy multiple predetermined parameters. Parameters defining operability may include the mere receipt of a signal from a sensor, elapsed time between a request for data by the circuit and receipt of said data, substantive quality of signals, sensor sensitivity, strength of power source, or other parameters. The parameters are modifiable to facilitate many different types of sensors without the addition of any additional circuitry. The system also monitors operability of the self-checking routine itself as well as checking the circuitry of a fire detection unit and strength of power source.

19 Claims, 9 Drawing Sheets

SYSTEM FOR MONITORING OPERABILITY OF FIRE EVENT SENSORS

CROSS REFERENCE TO RELATED APPLICATIONS

This application is a CIP of the prior filed, application Ser. No. 09/237,817, filed Jan. 27, 1999, U.S Pat. No. 6,081,195 which claims the benefit of application Ser. No. 60/072,850, filed Jan. 28, 1998, entitled SYSTEM FOR MONITORING OPERABILITY OF FIRE EVENT SENSORS.

BACKGROUND OF THE INVENTION

This invention relates to fire event sensing devices and, more particularly, to a system for automatically monitoring the operability of fire event sensors housed within a fire event detection unit.

Although the percentage of U.S. households having at least one fire detection device of some type has grown to over 92%, the percentage of deaths caused by residential fires has remained steady. The fact that approximately one-third of all fire detection devices are non-operational when needed is a key reason for this unfortunate statistic. A large number of fire-related incidents involving property damage, personal injury, or even death are attributable to malfunctioning fire detection units. Malfunctioning smoke, heat, carbon monoxide, or other fire event sensors, or even dead or disconnected batteries, are often the result of a lack of manual testing by residents. It is therefore desirable to have a system for automatically and continuously testing the operability of sensors housed within a fire detection unit whether they are smoke, heat, carbon monoxide or other fire event sensors.

Several methods and devices have been proposed to monitor the operability of various fire event sensing devices. In U.S. Pat. No. 4,595,914 to Siegel, a self-test circuit for a fire event detector is disclosed for automatically periodically testing whether the sensitivity of an ionization-type sensor is within a certain predetermined range. A fire event smoke alarm which automatically periodically tests the detector's operation or periodically sounds the detector's alarm to remind the occupant to manually test the alarm is disclosed in U.S. Pat. No. 4,965,556 to Brodecki. The prior art further includes several methods and devices for manually checking the functionality of combustion detection circuitry. In addition, U.S. Pat. No. 5,619,184 to Torikoshi discloses a system for disaster prevention having a sensor, a CPU, and a memory for comparing sensor data with stored data.

Although assumably effective in operation, such known methods and devices are incapable of monitoring the integrity and functionality of multiple types of fire event sensors housed within a single detection unit. In addition, the above referenced devices only provide a single test of integrity or operability, such as simulating a fire event within a predetermined fixed range of sensitivity or merely detecting whether any signal is received from a sensor. Significantly, the acceptable range of sensor sensitivity, actions to be taken based on self-test results, and the frequency of periodic checking can not be modified or adjusted without the replacement or addition of new circuitry. Further, the referenced devices do not allow the residential occupant to verify that the self-checking circuitry itself is functioning properly.

It is therefore desirable to have a system which automatically checks the integrity and operability of fire event sensors and power supply housed within a fire detection unit according to predetermined and modifiable parameters.

SUMMARY OF THE INVENTION

In response thereto I have invented a system which automatically checks the integrity and operability of fire event sensors housed within a fire detection unit. The system disclosed herein utilizes a programmable master logic circuit which compares data received from each sensor with multiple predetermined parameters, such as acceptable time duration between sensor readings, existence of signal, acceptable sensor sensitivity, strength of battery power, threshold levels of logical readings, and other parameters. The master logic circuit can be reprogrammed with a different set of parameters without the need for additional circuitry. The system further provides for manual testing of the integrity of the circuitry and monitors the operability of the sensor monitoring routine itself. An audible and/or visual alarm is activated if any of the predetermined operability parameters are violated, thus indicating a malfunction. The system further provides for manual resetting of all sensors following a fault caused by any sensor.

It is therefore a general object of this invention to provide a system for monitoring the operability of fire event sensors which automatically tests the operability of each sensor.

Another object of this invention is to provide a system for monitoring the operability of fire event sensors which continuously tests the operability of each sensor.

Yet another object of this invention is to provide a system for monitoring the operability of fire event sensors having a programmable logic circuit which monitors a sensor's operability according to a plurality of parameters for determining if each sensor is operating correctly.

A further object of this invention is to provide a system for monitoring the operability of fire event sensors having a logic circuit that may be reprogrammed with a different set of parameters and associated logic without the addition of new circuitry.

A still further object of this invention is to provide a system for monitoring the operability of fire event sensors having a means for manually testing the integrity of all circuitry.

Another object of this invention is to provide a system for monitoring the operability of fire event sensors having a means for monitoring the operability of the sensor monitoring system itself.

A further object of this invention is to provide a system for monitoring the operability of fire event sensors which can manually reset an alarm or sensors following activation.

A still further object of this invention is to provide a system for monitoring the operability of fire event sensors which sounds an audible and/or visual alarm when at least one fire event sensor or a battery is malfunctioning.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
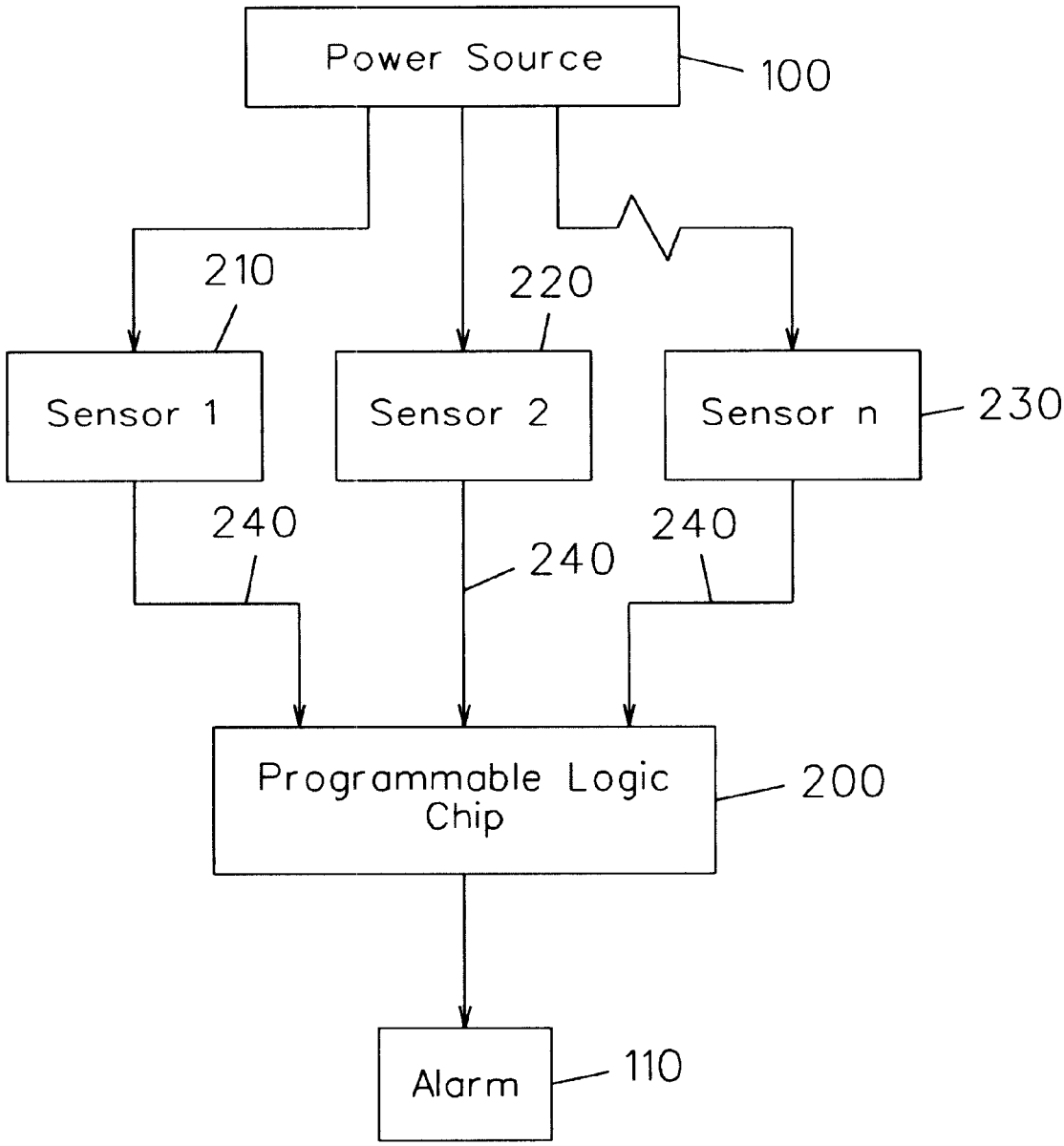
FIG. 1 is a block diagram of the monitoring system showing the major components of the monitoring system.

Turning more particularly to the drawings, FIG. 1 shows three fire event sensors 210, 220, 230 which can sense various conditions of ambient air characteristic of a fire event such as carbon monoxide, smoke, and heat, said sensors being known in the art. Although the preferred embodiment described herein and illustrated in the accompanying drawings shows three sensors, it is understood that the system described herein is adaptable to monitor the operability of a single or a plurality of fire event sensors. It is further understood that the system described herein is not constrained to a particular fire event detection device, but rather is adaptable for use in any such device.

Sensors 210, 220, 230 receive current from a common power source 100 such as a battery, said sensors 210, 220, 230 continuously sending a data stream 240 to a programmable logic circuit 200 according to a predetermined time cycle. Said data stream 240 includes readings relative to the particular air condition being sensed as well as information relative to the strength of the power source 100. The logic circuit 200 will determine and initiate the appropriate output, which may include actuation of an audible and/or visual alarm 110, following comparison of sensor data with predetermined parameters.

Figure 2:
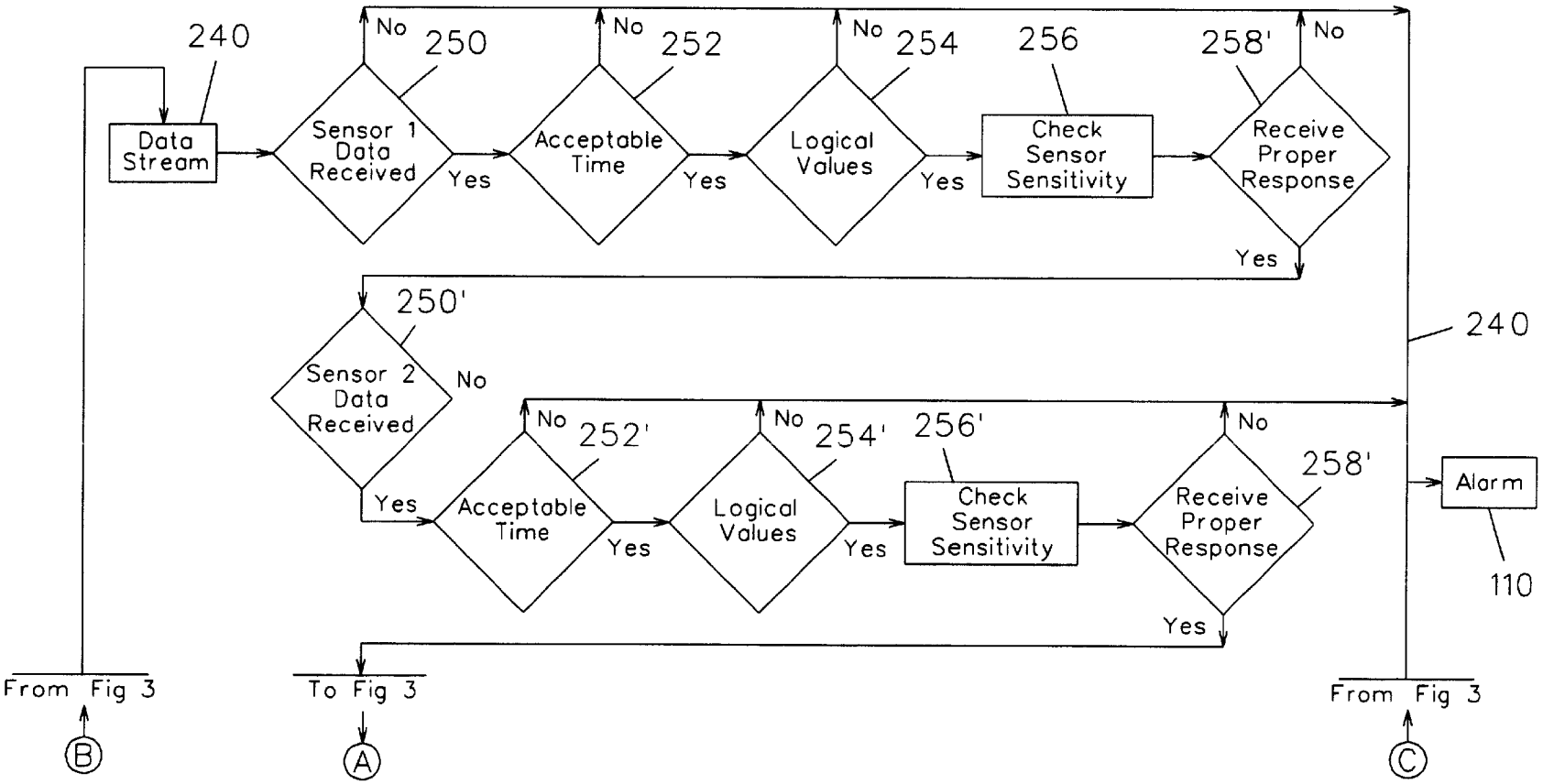
FIG. 2 is a flow chart showing the logic utilized by a programmable logic circuit.
Figure 3:
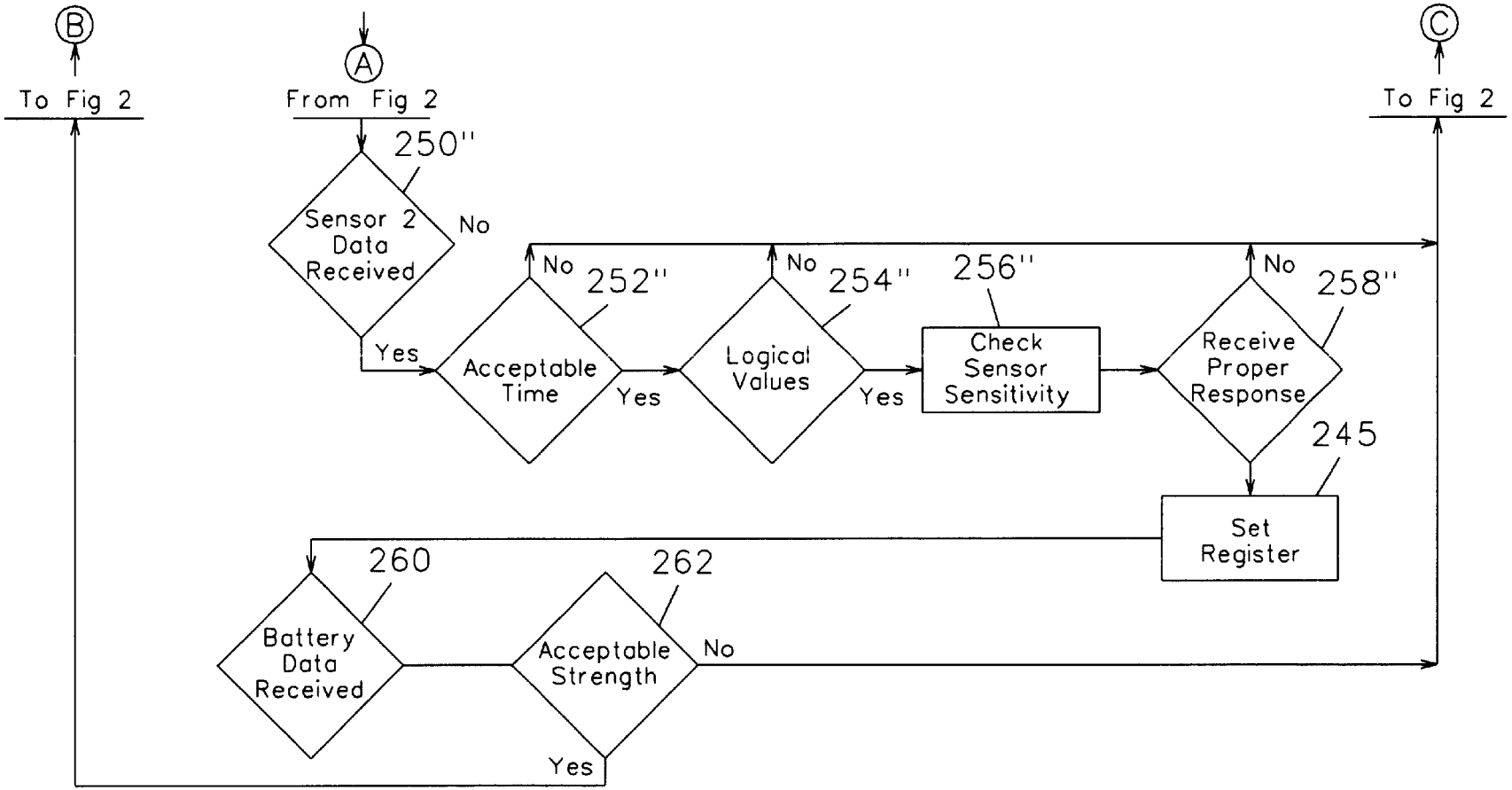
FIG. 3 is a flow chart showing the logic utilized by a programmable logic circuit.

FIGS. 2 and 3 present a flow chart showing the logic followed by the programmable logic circuit 200 for analyzing a data stream 240 to verify the operability of each sensor 210, 220, 230. It is understood that the particular parameters illustrated in FIGS. 2 and 3 are easily reprogrammable to facilitate various types of sensors that may be utilized or merely to modify the parameters which define "operability". The logic circuit 200 checks 250 whether any data has been received from a first sensor 210. Lack of data from said first sensor 210 may indicate said first sensor 210 is malfunctioning; thus, an audible and/or visual alarm is activated 110. If data from the first sensor 210 was received, the elapsed time since a prior reading was delivered is calculated and compared to a predetermined time parameter 252. If the elapsed time exceeds the parameter, an alarm is activated 110. However, if the prior tests 250, 252 are satisfied, the circuit 200 performs a qualitative data check 254, activating an audible and/or visual alarm 110 if the data is illogical when compared to predetermined parameters. Next, the circuit 200 checks the sensitivity of said first sensor 210 relative to the appropriate air condition according to predetermined parameters 256. Some types of fire event sensors such as heat or carbon monoxide sensors, can be tested by sampling surrounding ambient air or by sampling a thermometer. Other sensors, such as smoke sensors, can be tested by electrically simulating a fire event or by monitoring expected electronic pulses within the sensor circuitry using methods known in the art. If an appropriate response to the test 256 is not returned 258, an alarm is activated 110 to indicate a malfunctioning sensor.

In like manner, the logic circuit 200 proceeds to compare (250'–258') the data received from the next sensor 220 with parameters particular to the sensor 220, and so on (250"258") for as many sensors 230 as are housed within a detection device. The operability of each sensor 210, 220, 230 within a detection device is thereby silently monitored until a malfunction is detected. When the operability of all sensors has been verified, a register 245 is set which indicates the self-checking routine is functioning. It is understood that said register 245 is periodically automatically reset to avoid inaccurate verification if the self-checking routine subsequently fails. Manual verification of the self-checking routine is further described later. Receipt of data from the power source 100 is also monitored 260. If the strength of the power source falls below a predetermined level 262, an audible and/or visual alarm is activated 110.

Figure 4:
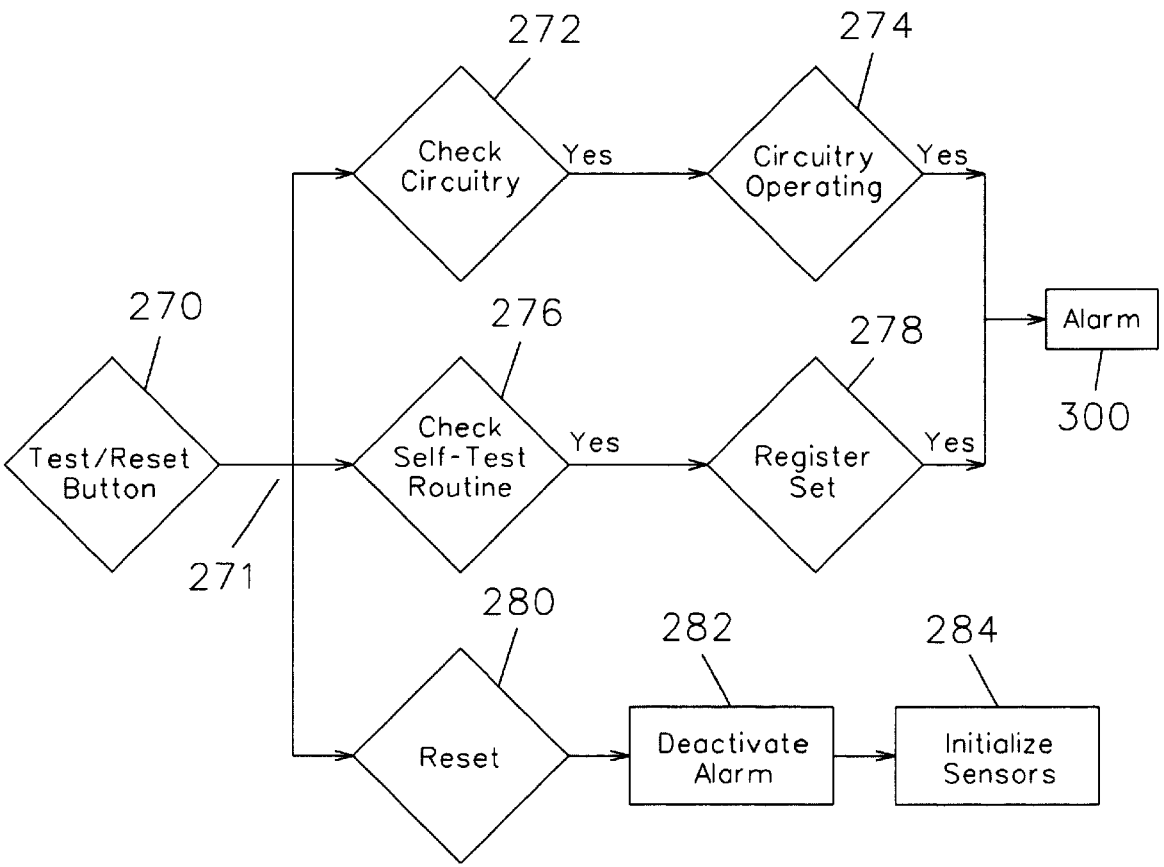
FIG. 4 is a flow chart showing the logic utilized by a programmable logic circuit.
Figure 5:
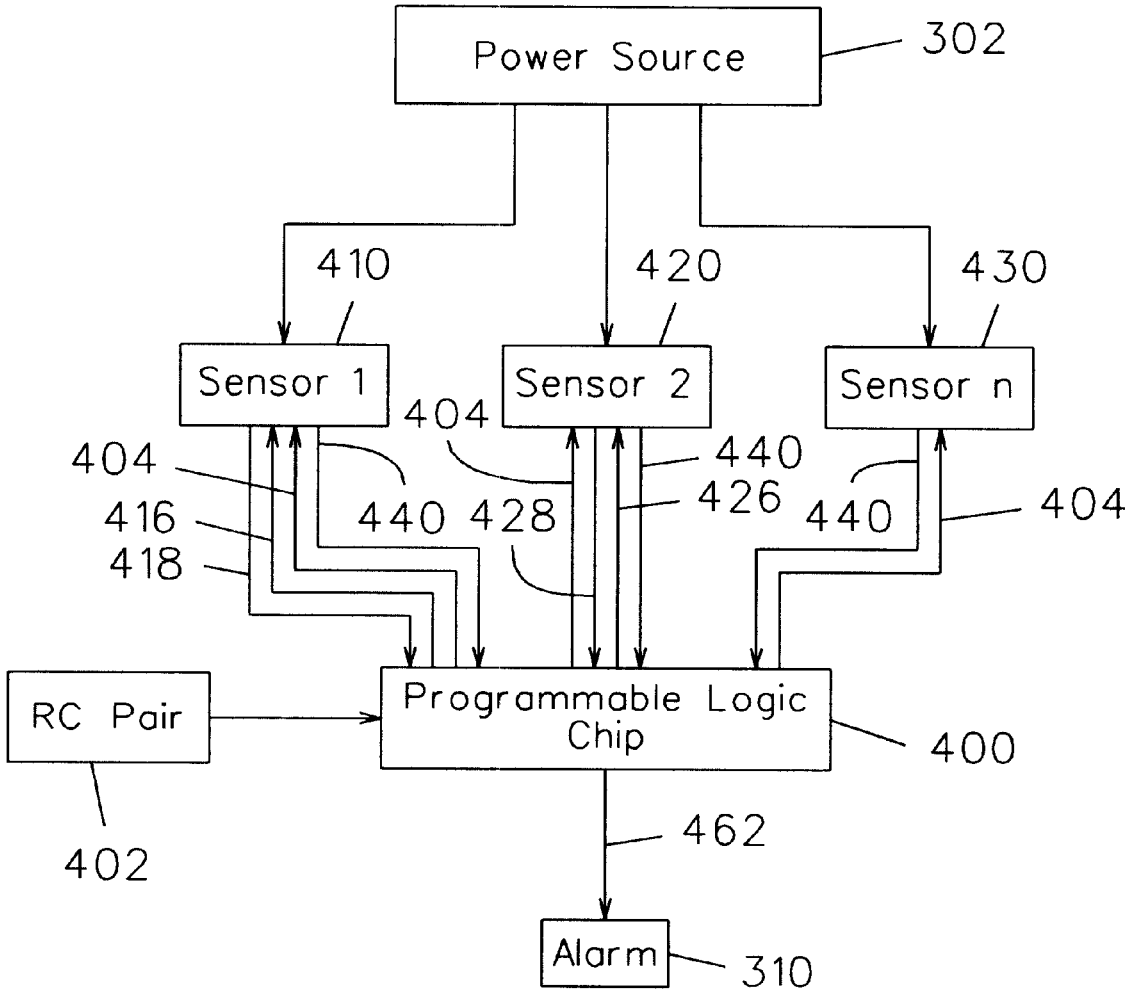
FIG. 5 is a block diagram of the now preferred embodiment of the monitoring system showing the major components of the monitoring system.

If a test/reset button of the type typically found on fire event sensing devices is engaged 270, the logic circuit 200 processes a decision tree 271 (FIG. 4). If a manual check of the detection unit circuitry is requested 272, the circuit checks the circuitry 274 and activates a momentary alarm 300 if the circuitry is operable. If a manual check of the self-checking routine itself is requested 276, the circuit 200 checks 278 the previously referenced register 245 and activates a momentary alarm 300 if the register is set. If a reset of all sensors is requested 280, the alarm 110, if sounding, is deactivated 282 and all sensors are initialized 284 to once again begin sensing and delivering readings to the logic circuit 200.

It is understood that the output signal 240 resulting from each sensor malfunction can vary so that the resulting alarm signal will likewise vary. Thus the user can determine which sensor is malfunctioning according to the type of alarm. Also within each sensor logic different signals can be produced according to the type of parameter malfunction so that the user can determine the type of malfunction within each sensor.

A now preferred embodiment of this system will now be described with reference to FIGS. 5–10. Sensors 410, 420, 430 receive current from a common power source 302 such as a battery. During routine operation, said sensors 410, 420, 430 send a data stream 440 to a programmable logic circuit 400 when prompted thereby according to a predetermined clock cycle. The clock cycle may be provided to the logic circuit 400 by a conventional resistor/capacitor (RC) pair 402. At predetermined time intervals of the RC pair 402, the logic circuit 400 transmits a signal 404 to each sensor to send data to the logic circuit 400 for analysis. In other words, the logic circuit 400 attempts to sample data from each sensor. The data stream 440 includes readings relative to the particular air condition being sensed as well as information relative to the strength of the power source 302. The logic circuit 400 will determine and initiate the appropriate output signal 462, such as actuation of the alarm 310, following analysis of the data stream 440 by the logic circuit 400 according to predetermined parameters. Use of a programmable logic circuit 400 facilitates monitoring of different types of sensors as well as monitoring the same types of sensors for use in different ambient air environments. For example, it may be desirable for a smoke sensor for use in a kitchen to have a greater smoke tolerance than a smoke sensor for use in a bedroom.

The alarm 310 may include a conventional tone generator which can emit various tones or tone patterns according to the signals received from the logic circuit 400. The alarm 310 may also include a plurality of light emitting diodes (LED's) having various colors which are activated according to signals received from the logic circuit 400. Various audio and visual alarm circuits are known which can process data signals and activate predetermined audio or visual responses accordingly.

Figure 6:
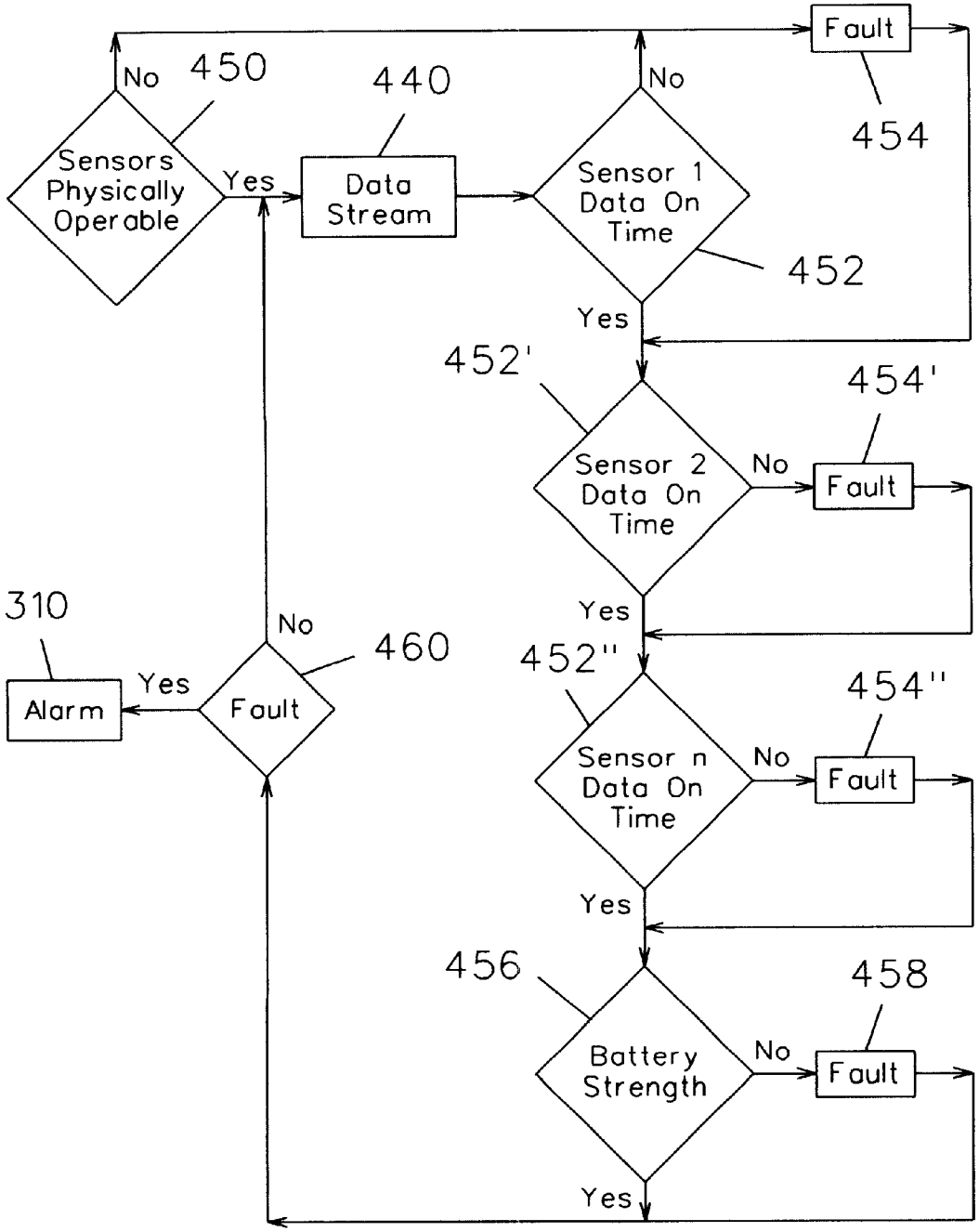
FIG. 6 is a flow chart showing the logic utilized by a programmable logic circuit according to the system of FIG. 5.
Figure 9:
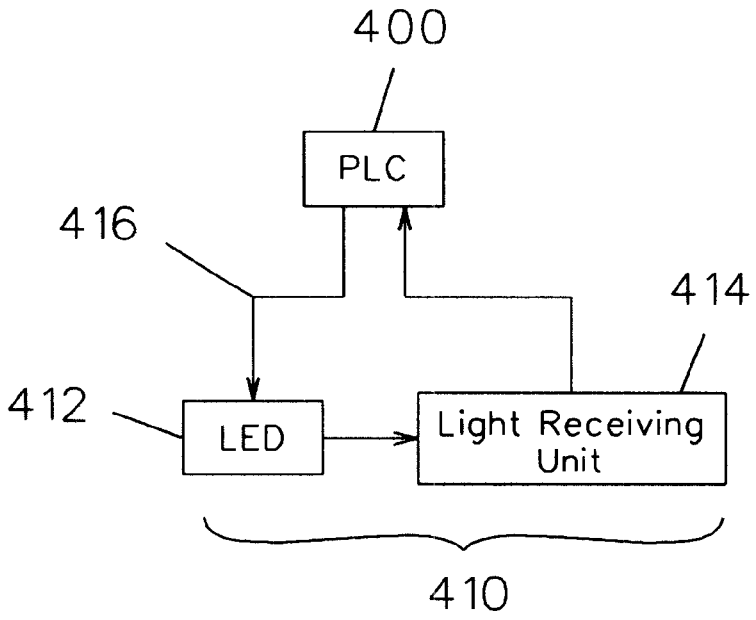
FIGS. 9 and 10 are block diagrams of embodiments of the monitoring system showing components of the sensors.
Figure 10:
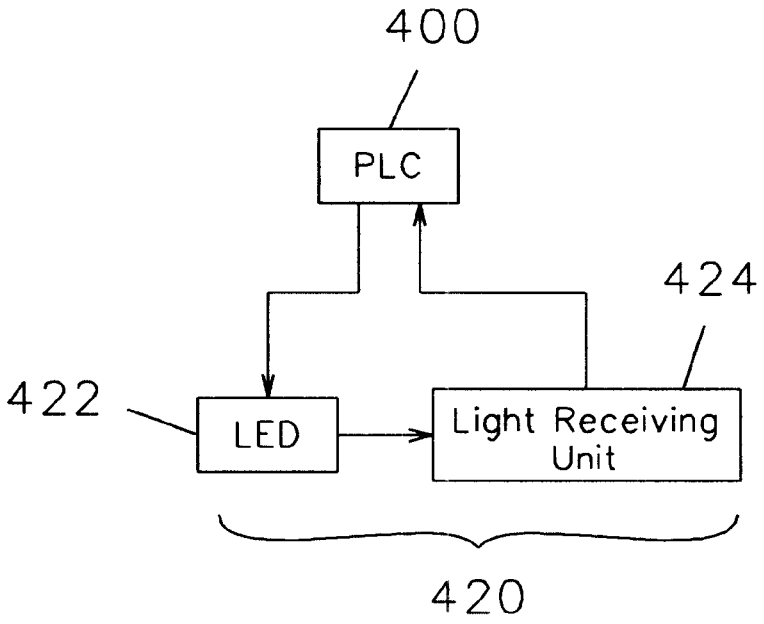

According to one aspect of the system, the operability of each sensor 410, 420, 430 is checked 450 at predetermined time intervals, preferably every 10 minutes, under the control of the programmable logic circuit 400 (FIG. 6). If the first sensor 410 is a smoke sensor, the logic circuit 400 sends a signal 412 to brighten or dim the sensor's internal LED 412 and then checks 418 that sensor's light receiving element 414 to be sure it responded appropriately to the brightening or dimming of the LED 412 (FIG. 9). If the expected response is not received, a fault is registered and the logic circuit 400 sends signals 462 to an audio and/or visual alarm 310 to indicate a sensor malfunction as well as indicating which particular sensor is malfunctioning. If the second sensor 420 is a carbon monoxide sensor, the logic circuit 400 sends a signal 426 to the sensor's internal LED 422 and checks 428 the sensor's light receiving element 424 to be sure it responded appropriately (FIG. 10). In the case of a heat sensor, the logic circuit 200 samples the heat sensor to be sure that it returns data in the data stream 440 having a data type indicative of a temperature reading. Therefore, this aspect of the self-checking routine monitors the physical operability of the sensors without regard to qualitative data. It is understood that the parameters controlling the tests of sensor sensitivity are reprogrammable according to the particular sensors being monitored or the level of sensor sensitivity desired.

In another aspect of the system (FIG. 6), the logic circuit 400 signals 404 the sensors 410, 420, 430 approximately every 30 seconds to return a data signal relative to a particular ambient air condition. The timing of the signal 404 to return a data stream is controlled by a conventional RC pair 402, as previously described. This initiates a data stream 440 from the sensors to the logic circuit 400. If no signal is returned from a first sensor 410 within a predetermined time 452, a fault is registered 454 in the logic circuit 400 and the logic circuit 400 proceeds to analyze the data from the second sensor 420. However, if data from the first sensor 410 is timely received, the logic circuit 400 proceeds to analyze data received from the second sensor 420 without registering a fault.

In like manner, the logic circuit 400 proceeds to check whether data was received from the next sensor 420 within a predetermined time and so on for as many sensors 430 as are housed within a detection device, as indicated at blocks 452' and 452" of FIG. 6. A fault is registered 454', 454" if a signal is not timely received. Receipt of data from the power source 302 is also monitored 456 and a fault is registered 458 in the logic circuit 400 if the strength thereof falls below a predetermined voltage level. This routine is continuously repeated according to the clock cycle such that the operability of each sensor 410, 420, 430 and the power source 302 within a detection device are silently monitored until a malfunction is detected.

A fault indicates that a sensor may be malfunctioning. Thus, following analysis of the data from each sensor 410, 420, 430, the logic circuit 400 delivers signals to the audio and/or visual alarms 310 if a fault has been registered to indicate a sensor malfunction 460 as well as to indicate which particular sensor is malfunctioning.

If a test/reset button of the type typically found on fire event sensing devices is engaged 500, the logic circuit 400 initiates tests 502, 504, 506 of the operability of the sensors 410, 420, 430, respectively, in a manner substantially similar to the sensor sensitivity tests which are automatically initiated approximately every 10 minutes as described above and shown in FIG. 6. However, this manually initiated self-testing routine includes a series of timing delays 508 between tests such that a user is better able to verify the operability of each sensor. Preferably, the logic circuit 400 sends a signal to the alarm 310 to momentarily indicate (e.g. for 5 seconds), audibly and/or visibly, that a particular sensor is functional before testing the next sensor. The timing delays can be accomplished with the conventional resistor/capacitor pair 402 communicating with the logic circuit 400.

In addition, the circuit is automatically reset if an endless loop is encountered during routine circuit operation, the reset causing the alarm 310 to momentarily activate. Thus, a user is alerted if the self-checking circuit itself suffers a malfunction.

It is understood that the output signal 462 resulting from the circuit's analysis of the integrity of the sensors can vary so that the resulting alarm signal will likewise vary. Thus the user can determine which sensor is malfunctioning according to the type of alarm. Also within each sensor logic different signals can be produced according to the type of parameter malfunction so that the user can determine the type of malfunction within each sensor. LED's corresponding to particular sensors can be illuminated by particular signals from the logic circuit 200 as well as for indicating a particular sensor malfunction.

It should also be appreciated that the present system is particularly well-suited for use with certain fire event sensors which are known in the art. For example, a carbon monoxide sensor is known which self-checks itself following detection of an alarm activating level of carbon monoxide and subsequent recovery. This is desirable since recovery of the CO sensor is never entirely complete and eventually will require sensor replacement.

Figure 7:
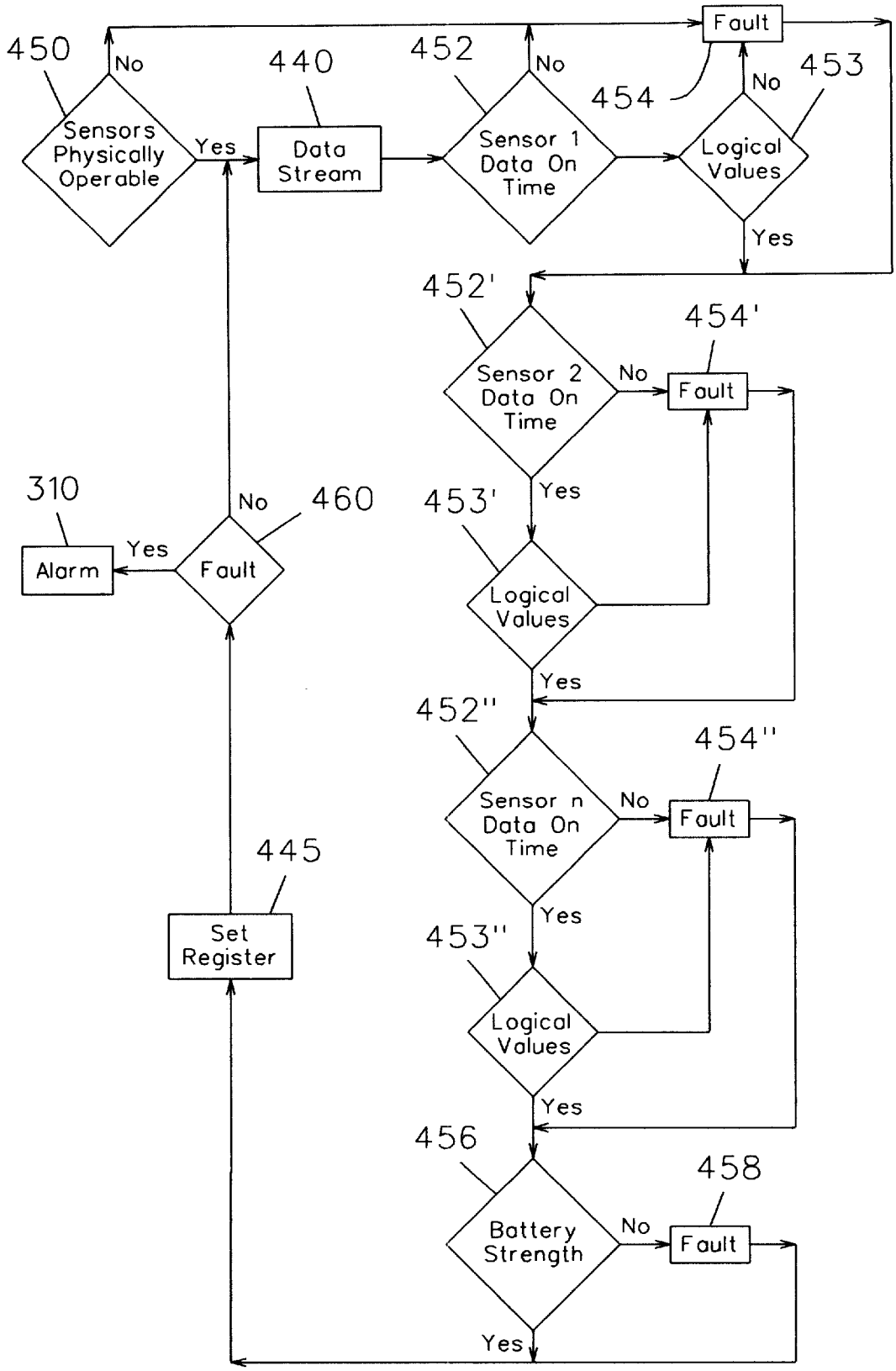
FIG. 7 is a flow chart showing the logic utilized by a programmable logic circuit according to the system of FIG. 5.
Figure 8:
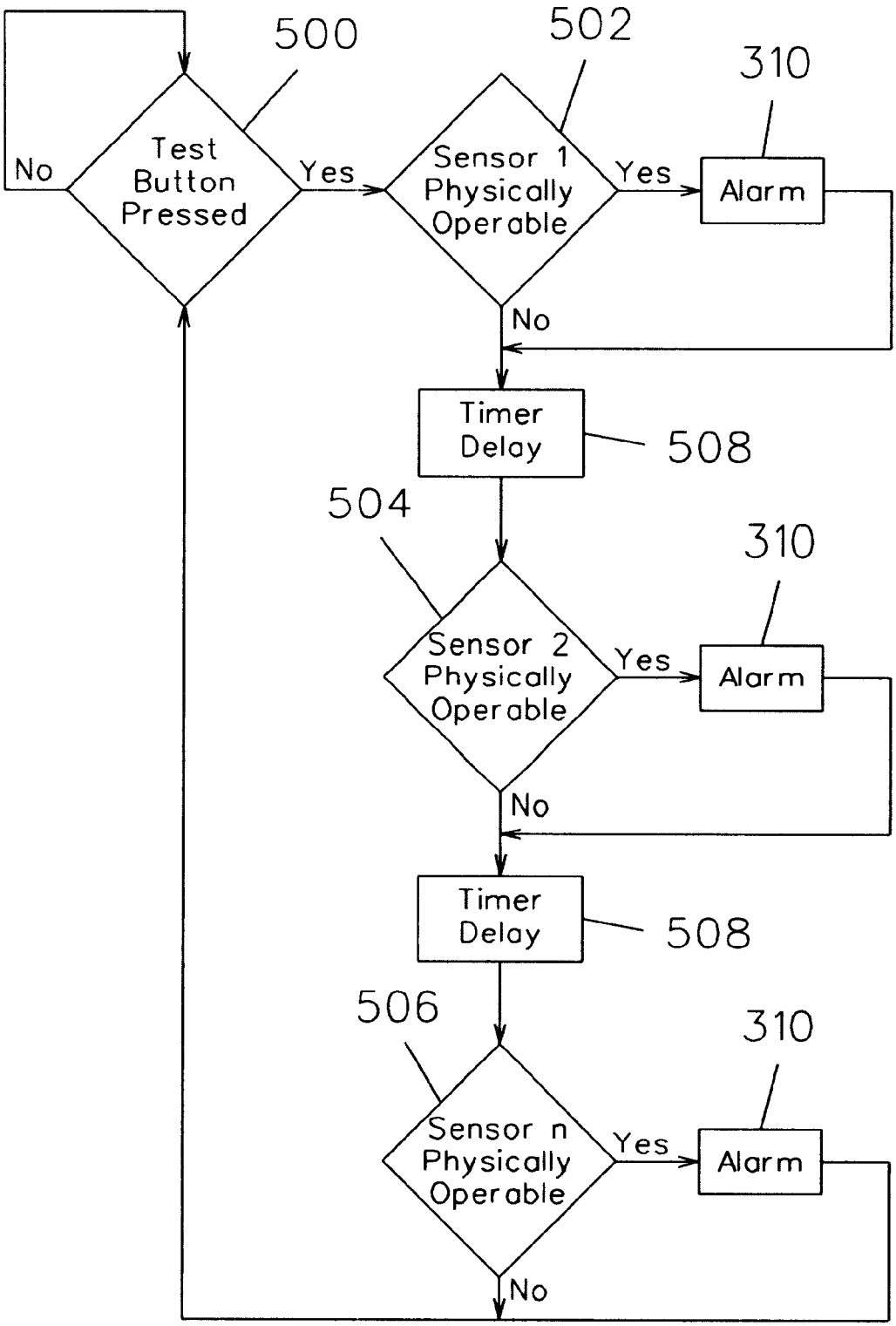
FIG. 8 is a flow chart showing the logic utilized by a programmable logic circuit according to the system of FIG. 5.

In another embodiment of the invention, the circuit 400 operates in a manner substantially similar to that described above relative to the now preferred embodiment except as specifically noted below (FIG. 7). As shown in FIG. 7, data that is timely received from the first sensor 410 is qualitatively analyzed 453 by the circuit 400 according to predetermined parameters. If the data is illogical when compared to the predetermined parameters, a fault is registered 454 and the circuit 400 proceeds to analyze data from the next sensor. The data received from each sensor is analyzed 453', 453" and faults are registered 454', 454" in like manner. For example, a sensor reading of 1000 would be considered illogical and indicative of a sensor malfunction if a reading of between 50 and 120 was expected. It is understood that this qualitative data check is similar to the test the circuit 400 makes while determining the existence of a fire event and, therefore, may be performed using the same sensor reading so long as the reading was deemed "logical".

In addition to momentarily activating the alarm 310 upon a malfunction of the self-checking routine itself as described previously, the integrity of the routine is monitored by setting a register 445 after all sensors have been checked. This register 445 may later be checked by a user upon pressing a test button. It is understood that the register 445 is periodically automatically reset to avoid inaccurate verification if the self-checking routine subsequently fails.

Accordingly, it can be seen that this system can monitor the operability of a plurality of fire event sensors by continuously comparing sensor data to a set of parameters. The set of parameters is modifiable with no addition or change in circuitry.

Although a now preferred embodiment of the invention has been above described it is not to be limited thereto except as set forth in the following claims and allowable equivalents thereof.

Having thus described the invention, what is claimed as new and desired to be secured by letters patent is as follows:

1. A device for determining the efficacy of an air condition detector utilizing at least one sensor to provide a data signal corresponding to a preselected parameter of a condition of the ambient air, said device comprising:

an alarm;

a programmable logic circuit capable of evaluating input data supplied thereto, said circuit including means for requesting a receipt of said input data from the at least one sensor and means for generating an output signal to energize said alarm;

a power source for said alarm and programmable logic circuit;

means for providing said input data to said circuit for evaluation indicative of an elapsed time between a time of a request by said circuit requesting means for said input data and a time of receipt by said circuit of said requested input data, said circuit including means for comparing said elapsed time to a predetermined time parameter, said circuit generating said signal for energizing said alarm if said elapsed time is at an undesirable relationship with said time parameter, whereby to continuously monitor the operation of said detector.

2. The device as claimed in claim 1 wherein said circuit further comprises means utilizing said input data from the at least one sensor for evaluating a desired qualitative operation of the at least one sensor in the detector, said circuit generating said signal for energizing said alarm if said evaluated sensor data indicates an undesirable operation of the at least one sensor.

3. The device as claimed in claim 2 wherein said means for determining a desired qualitative operation of the at least one sensor comprises a preselected parameter in said logic circuit indicative of said data type measured by the at least one sensor, said data type parameter utilized in said logic circuit evaluation for comparison with input data from the sensor indicative of the data type measured by the at least one sensor.

4. The device as claimed in claim 3 wherein said data type parameter is a preselected condition of the ambient air measured by the at least one sensor.

5. The device as claimed in claim 3 wherein said preselected data type parameter includes a value of said data type measured by the at least one sensor, said circuit generating said signal for energizing said alarm if a value of said input data is at an undesirable relationship with said data type parameter value.

6. The device as claimed in claim 1 further comprising means for providing data indicative of operation of said power source, said circuit generating said signal for energizing said alarm if said evaluated power source data includes an inoperability of said power source.

7. The device as claimed in claim 6 wherein said means for providing data indicative of operation of said power source comprises a preselected parameter in said logic circuit indicative of an operation of said power source, said power source parameter utilized in said logic circuit evaluation for comparison with said input data indicative of operation of said power source.

8. A device as claimed in claim 1 wherein said power source is a battery.

9. A device as claimed in claim 1 further comprising a means for verifying that said logic circuit has evaluated an operation of the at least one sensor within a predetermined time period.

10. A method for determining the efficacy of an air condition detector utilizing at least one sensor to provide a signal corresponding to a preselected parameter of a condition of the ambient air, said method comprising the steps of:

providing an alarm;

providing a programmable logic circuit;

providing a power source for said alarm and programmable logic circuit;

demanding from the at least one sensor in the detector data indicative of sensor operation for receipt by said circuit;

measuring an elapsed time between a time of said data demand and a receipt of said data by said circuit for evaluation indicative of a desirable operation of the at least one sensor in the detector;

providing said elapsed time to said circuit for comparison to a predetermined time parameter;

energizing said alarm if said measured elapsed time is at an undesirable relationship with said time parameter; and repeating said above steps to continuously monitor the efficacy of said detector.

11. The method as claimed in claim 10 further comprising the steps of:

providing the logic circuit with a second preselected parameter corresponding to the type of ambient air condition to be sensed by the at least one sensor; comparing the type of said data provided to said circuit by the at least one sensor with said second parameter;

energizing said alarm generated if the data type of said second parameter and data type of said sensor data are at an undesirable relationship.

12. The method as claim in claim 11 wherein said predetermined second parameter includes a value of said data type, said signal for energizing said alarm generated if said input data provided to said circuit for evaluation indicative of operation of the at least one sensor is at an undesirable relationship with said second parameter.

13. The method as claimed in claim 10 further comprising the steps of:

providing data to said circuit for evaluation indicative of operation of said power source:

energizing said alarm if the evaluated power source data indicates an inoperability of said power source.

14. The method as claimed in claim 13 wherein said step of providing data to said circuit for evaluation indicative of operation of said power source includes comparing said data indicative of operation of said power source with a predetermined parameter indicative of the desired operation of said power source, said signal for energizing said alarm generated if said provided power source data is at an undesirable relationship with said powe4r source strength parameter.

15. The method as claimed in claim 10 further comprising the step of verifying that said steps of claim 10 have been performed by said logic circuit within a predetermined time period.

16. The method as claimed in claim 10 wherein said predetermined time parameter corresponds to a maximum elapsed time between said demand from the at least one sensor and said receipt of the demanded data.

17. A method for determining the efficacy of an air condition detector utilizing at least one sensor to provide data corresponding to a preselected parameter of a condition of the ambient air, said method comprising the steps of:

providing an alarm;

providing a programmable logic circuit;

providing a power source for said alarm and programmable logic circuit;

providing data to said circuit for evaluation indicative of operation of said power source;

energizing said alarm if the evaluated power source data indicates an inoperability of said power source;

providing data to said circuit indicative of operation of the at least one sensor in the detector, said data including a first parameter in said logic circuit corresponding to the type of data to be sensed by the at least one sensor upon a proper operation thereof and data measured by the at least one sensor;

utilizing said logic circuit to compare said first parameter with said data measured by the at least one sensor;

generating a signal in said logic circuit if said data type sensed by the at least one sensor does not match said first parameter, said signal energizing said alarm; and repeating said above steps to continuously monitor the efficacy of said detector.

18. The method as claimed in claim 17 further comprising the steps of:

demanding data from the at least one sensor for receipt by said circuit;

measuring an elapsed time between a time of said data demand and said receipt of said data by said circuit;

providing said elapsed time to said logic circuit for comparison to a predetermined time parameter; and generating a signal in said logic circuit for energizing said alarm if said elapsed time is at an undesirable relationship with said time parameter.

19. The method as claimed in claim 18 wherein said relationship comprises that said elapsed time is not less than said maximum time parameter.

* * * * *